United States Patent [19]

Paolini

[11] 4,080,001

[45] Mar. 21, 1978

[54] TAKE-UP FOR MINING MACHINE TRIM CHAIN

[75] Inventor: Alfred P. Paolini, Columbus, Ohio

[73] Assignee: Dresser Industries, Inc., Dallas, Tex.

[21] Appl. No.: 731,874

[22] Filed: Oct. 13, 1976

[51] Int. Cl.[2] ..... E21C 25/50

[52] U.S. Cl. ..... 299/78; 74/242.1 FP; 74/242.14 R; 299/82

[58] Field of Search ..... 74/242.8, 242.1 R, 242.1 A, 74/242.1 FP, 242.12, 242.14; 299/78, 64, 82, 76

[56] References Cited

U.S. PATENT DOCUMENTS

| | | | |
|---|---|---|---|
| 2,937,015 | 5/1960 | Jerrit | 299/82 |
| 3,722,317 | 3/1973 | Johnson | 74/242.14 R |
| 3,844,618 | 10/1974 | Delli-Gatti, Jr. | 299/64 |
| 3,934,361 | 1/1976 | Johnson et al. | 74/242.1 R |
| 3,950,031 | 4/1976 | Krekelen | 74/242.1 FP |

*Primary Examiner*—Ernest R. Purser

*Assistant Examiner*—William F. Pate, III

*Attorney, Agent, or Firm*—John M. Lorenzen

[57] ABSTRACT

An improved trim chain take-up is provided for mining machines in which the trim chain extends around the rotary cutting auger and the auger support arm and is driven by the auger to cut clearance for the support arm. The take-up includes a yoke slideably mounted behind each auger support arm in guide means affixed to the machine framework, and supports a cylindrical idler roller in a manner allowing free rotation of the roller. The idler roller bears against the inner side of the endless chain loop and tensions the chain when the yoke is pushed away from the auger support arm by push means mounted either on the frame or integral with the yoke. A locking device in the embodiment of a self-actuating wedge shaped spacer is included with the take-up to be positioned between the take-up and auger support arm to prevent the take-up from backing off even when the push means relaxes.

13 Claims, 7 Drawing Figures

TAKE-UP FOR MINING MACHINE TRIM CHAIN

This invention relates to an improvement in continuous mining machinery, particularly to miners having a rotary drum-type auger supported transversely across the front of the machine, and still more particularly to an improved take-up for the trim chain which cuts clearance for the auger support arms.

A mining machine of the general type referred to is described in U.S. Pat. No. 3,318,638. It consists of a frame mounted on crawlers, a cutting head and a gathering head mounted at the forward end of the frame, and a central conveyor extending from the gathering head to the rear of the machine. The cutting head comprises a drum-type auger disposed on an axis transverse to the machine centerline and parallel to the mine face. The auger is supported from the forward end of the frame by arms which also enclose the gearing which transmits rotary motion to the auger.

In many such machines, such as the one shown in the aforementioned patent, a trim chain is provided to cut clearance for the auger support arm. The chain, which is fitted with cutting bits, extends around a sprocket on the rotary auger and is driven by the same. The chain also passes around the idler sprocket usually mounted rearward of the support arm in an open framework formed by the auger gear case housing.

Because of the rough cutting job required of the trim chain and because of the rugged mine environment, trim chains tend to wear and stretch rapidly. Therefore, the idler sprocket is part of a take-up device which allows adjustment to correct the chain tension for optimum chain performance. Heretofore, the take-up devices has usually been a sprocket mounted on a holder which can be moved away from the support arm by a mechanical lead screw. This device is typical of take-up devices used in many other applications. However, in the mine environment, mechanical lead screws are found to corrode and jam or freeze, thereby making the job of adjusting chain tension difficult.

As an alternative to mechanical lead screws, hydraulic means, such as a push-type cylinder, have been used in some cases. The difficulty in maintaining adequate pressure in the hydraulic means has required the addition of mechanical locking devices to prevent the take-up from receding when the pressure to the hydraulic means decreases. But so far, none have been satisfactory for the application.

It is therefore the principal object of the invention to provide a take-up for trim chains which is strong and dependable, simple and economical to manufacture, easy to operate, and which includes an improved locking device that overcomes other problems encountered with the prior art take-up devices.

This is achieved by a sprocketless take-up comprising a cylindrical roller mounted for free rotation in a yoke. The yoke is slideably mounted in guides affixed to the auger gear case frame such that the yoke and roller can move away from the auger support arm to adjust the trim chain tension. A simple hydraulic cylinder integral with the yoke pushes against the support arm to tighten the chain. A self-activating locking device moves automatically into the space between the support arm and yoke to take the load off the cylinder and insure that the take-up doesn't back off or relax if the cylinder pressure drops. The locking device comprises a wedge shaped spacer slideably mounted on a vertical rod mounted on the guides attached to the frame such that as the take-up is moved away from the support arm the spacer slides into the developed space between the yoke and support arm.

This take-up device has several features which provide advantages over the prior art devices. The idler roller provides smoother chain action than the sprockets used before. The yoke is rugged, yet simple in design. It is strong enough to withstand the high chain tension, and, as mounted in the slide guides, moves dependably and smoothly when adjustment is necessary. There is no lead screw to corrode or otherwise freeze up.

The hydraulic device for effecting adjustment of the take-up is a simple grease cylinder. Although this cylinder could be mounted on the support arm, it is preferable to incorporate it into the yoke itself. The piston of this cylinder pushes against the auger support arm housing when actuated.

The use of this simple hydraulic device is made possible by the concurrent use of the self actuating locking means which immediately moves into place where it can take all or part of the load off the cylinder. The particular wedge shaped locking device has the additional feature that it allows continuous or non-incremental adjustment.

A more detailed description of the invention and its distinguishing features follows below with reference to the accompanying drawings which form part of this specification and of which:

Figure 1:
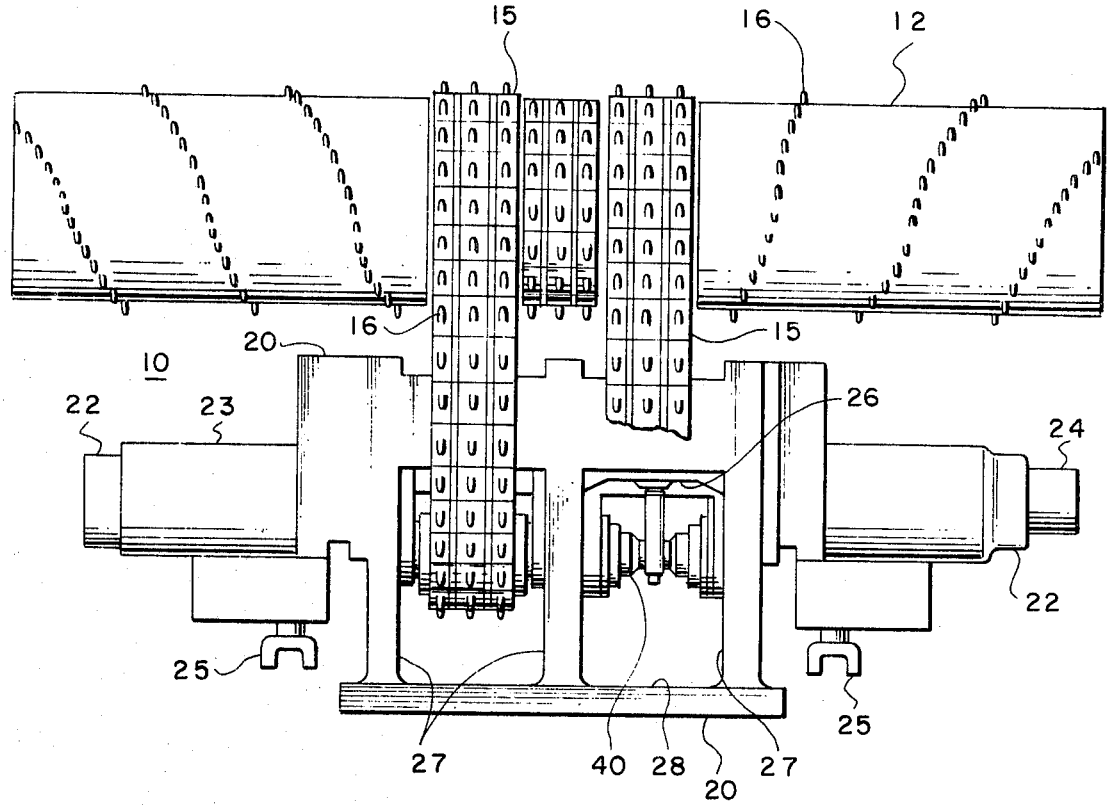
FIG. 1 is a plan view of the cutting head of a continuous drum-type mining machine showing a representative application for the invention.
Figure 2:
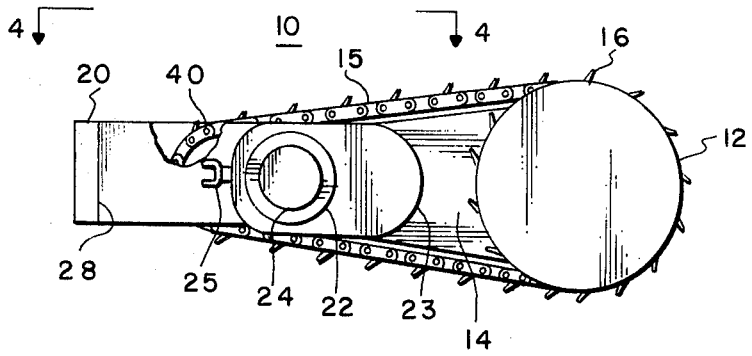
FIG. 2 is a side elevation of the cutting head shown in FIG. 1.
Figure 3:
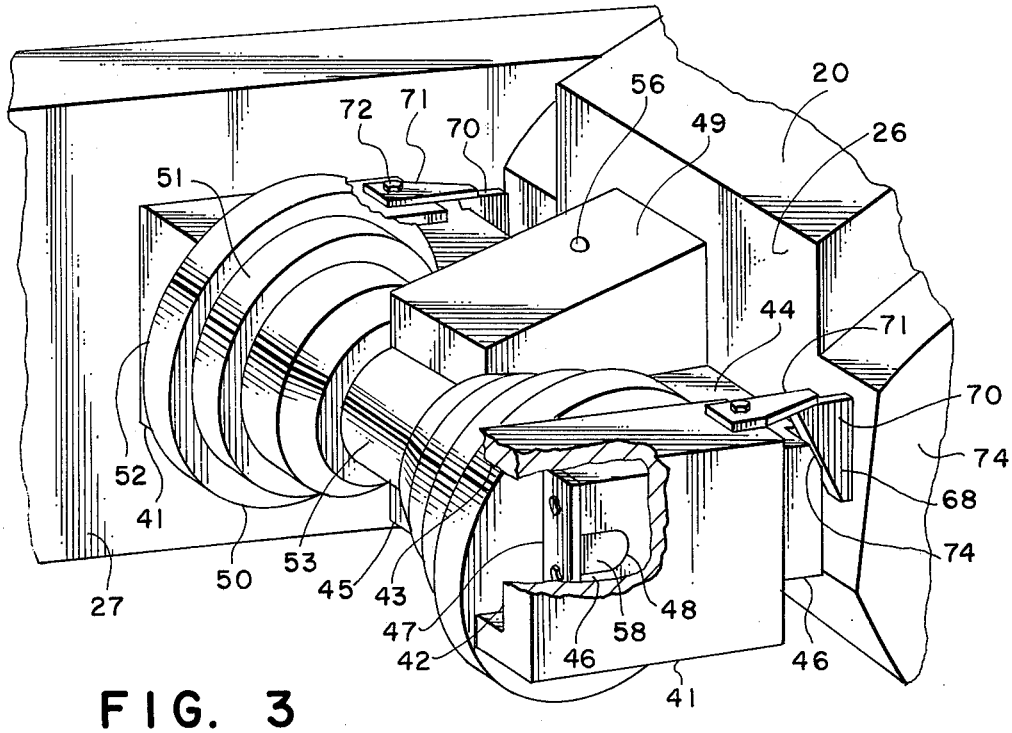
FIG. 3 is an isometric view of an improved trim chain take-up embodying the invention.

FIGS. 1 and 2 show a representative cutting head 10 from a mining machine. As used herein the term "cutting head" includes the rotary cutting drum or auger 12, the auger gear case designated generally at 20, the auger support arms 14 and the trim chains 15. The auger and trim chains are provided with cutting bits 16 which do the actual mining.

The back wall 28 of gear case 20 bolts rigidly to the frame of the mining machine. There are usually two motors on the machine which transmit power respectively to the right and left sides of the gear case 20 through mechanical shafts connected to the universal connections 25. The power is further transmitted through reduction gearing in the housing 23 and through gearing enclosed in the auger support arms 14 to the auger head 12. The gear case 20 further includes clutch and brake units 22 and 24 respectively.

Two openings in the gear case 20 are formed by the walls 26, 27, and 28. The auger support arms are integral with the gear head 20. Each trim chain is driven by a sprocket on the auger head and passes around the respective support arm 14 and through the opening in the gear case. A take-up unit 40 is mounted to the gear case 20 in the opening and works against the wall 26 to tension the trim chain 15. Since the support arms are rigidly attached to the gear case, in the discussion which follows the wall 26 is also referred to as the back of the auger support arm, and walls 27 and 28 can be considered part of the machine framework.

Referring now to FIGS. 3 through 6, the take-up 40 is shown in greater detail. Unlike the prior art take-ups which used idler sprockets, the present take-up uses a freely rotatable roller 50 which provides a smoother chain operation and steady rather than jerking forces on the take-up. The trim chain rides on the cylindrical bearing surfaces 51 of the roller between the aligning and retaining flanges 52.

The idler roller 50 is mounted on bearings 57 on the inner non-rotatable shaft 58. The shaft 58 is in turn mounted in a yoke 45. The yoke includes a central vertical rib 49 and two vertically oriented slide plates 46 which are connected on opposite sides of the rib 49 by lateral webs 44 in an integral structure. The flattened opposite ends of shaft 58 are held in matching slots 48 in the respective slide plates 46 by the retainers 47 which bolt to the side plates. A semicircular recess in the rib 49 is spaced slightly from the outer hub 53 which extends rigidly between the bearing surfaces 52 of the roller 50.

The end plates 46 of the yoke 45 are slideably mounted in guide blocks 41 which are in turn rigidly attached to the opposite side walls 27 of the opening in the auger gear case. The guide blocks 41 consist of a vertical wall 42 connecting two inwardly extending flanges 43.

Figure 6:
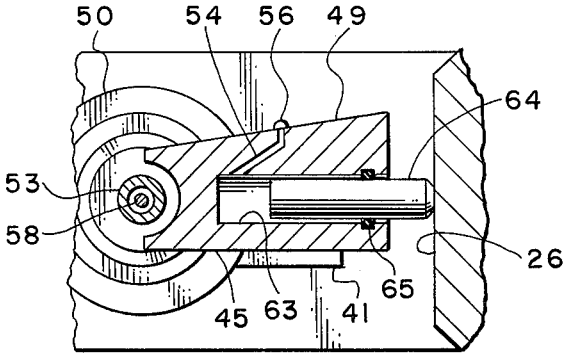
FIG. 6 is a partial elevation view in section as taken along the line 6—6 in FIG. 4.
Figure 7:
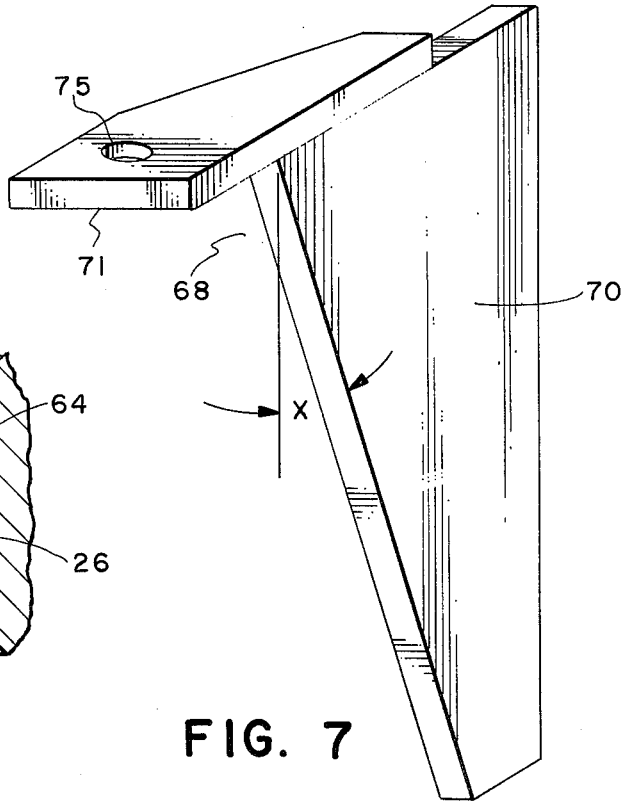
FIG. 7 is an isometric view of the spacer means employed in the take-up device shown in FIGS. 3 through 6.
Figure 4:
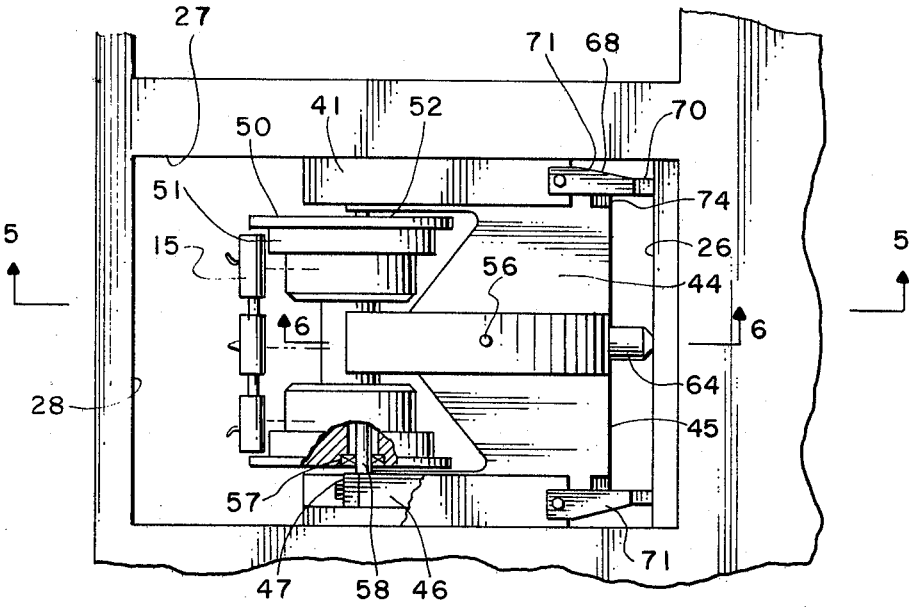
FIG. 4 is a plan view of the take-up device of FIG. 3.
Figure 5:
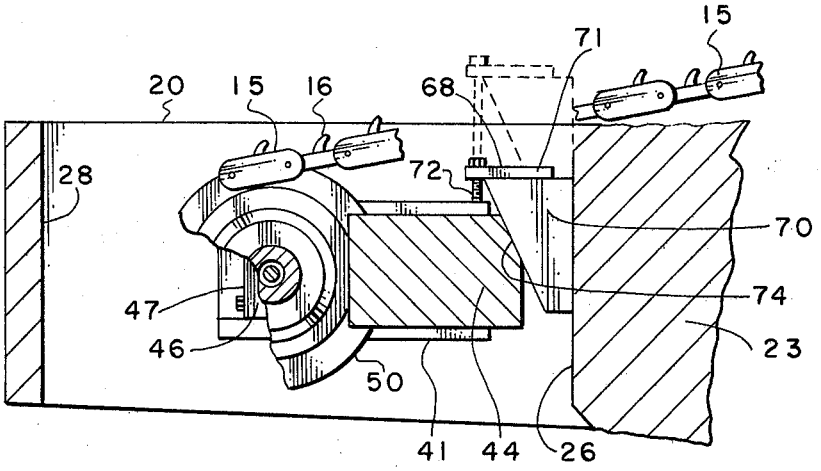
FIG. 5 is a side elevation view in section as taken along the line 5—5 in FIG. 4.

Referring to FIG. 6, a simple hydraulic device in the form of a grease cylinder is incorporated in the yoke member 45. A cylindrical grease chamber 63 extends into the yoke from the end opposite the roller 50. A cylindrical piston 64 is mounted in the chamber 63 through an O-ring or other seal means 65. Passageway 54 connects the grease chamber 63 to a grease fitting 56 accessible on top of the yoke 45.

When grease under pressure is introduced into the chamber 63, the piston 65 extends out against the wall 26 at the back end of the auger support arm. This action causes the yoke 45 to slide in guides 41 away from the wall 26 and thereby tighten the trim chain 15. Thus when a trim chain becomes worn or stretched, adjustment of the chain tension is accomplished by this grease cylinder and regulated by control of the pressure applied to it.

While this simple device works well, other types of fluid actuated devices, such as air or hydraulic oil cylinders, could be used instead to effect movement of the yoke 45. It should also be readily apparent that the cylinder could be incorporated in or attached to the gear case 20 or support arm 14, but the described arrangement is considered more convenient.

As mentioned earlier, although the hydraulic cylinder is effective to adjust chain tension initially, it is difficult to maintain the applied pressure during operation of the machine in order to maintain the chain tension. This problem is further affected by the jerking action of the chain when it is cutting into the mine face.

Therefore it has been found desirable to include a locking device as part of the take-up unit. A few such devices have been tried in the past with less than satisfactory results. In one design, a series of individual spacers were manually placed between the take-up and the auger support arm. In another, a plate connected to the movable take-up was provided with a series of spaced holes which would successively pass over a matching hold fixed permanently with respect to the support arm when the take-up moved. After the chain was adjusted, a pin or rod was inserted into the matching holes to lock the take-up in place. This device proved to have a couple of serious drawbacks. First, since the pins had to be sufficiently large to withstand the forces exerted by the chain, adjustment could only be made in sizeable increments, usually of $\frac{7}{8}$ inch or more. Secondly, a locking device is generally required on each side of the take-up, and occasionally the operator would get a pin on one side in a different hole than on the other side. This resulted in the unit being cocked leading to wear and failure of the chain and/or take-up unit.

The present take-up also incorporates a locking device to take the load from the adjusting cylinder, but one that is more dependable and effective than those used heretofore. Referring again to FIGS. 3 through 7, the locking device 68 consists of a self actuating wedge-shaped spacer 70 which moves down into the space between the yoke 45 and the wall 26 whenever the take-up is adjusted to increase chain tension.

In the particular embodiment shown, the locking device includes a horizontal bracket 71 which extends beyond one end and laterally to one side from the top of the wedge shaped spacer 70. A hole 75 is provided in the extended portion of the bracket. The locking device is connected to the gear case 20 by a bolt or rod 72 which passes through the hole 75 in the bracket 71 and is threadably inserted in a hole in the top flange 43 and web 42 of the guide block 41. The guide rod 72 is approximately the same length or slightly longer than the spacer 70, and is smaller in diameter than the rod 72. Thus the locking device can slide freely in the vertical direction along the portion of the rod 72 not threaded into the guide block 41.

The operation of the locking device will be described beginning with the situation in which a new trim chain has been installed and the take-up is fully retracted; i.e., the yoke is close to the wall 26. In this position the rod 72 should be in an elevated position and the spacer 70 will also be at its highest position as indicated by the broken line in FIG. 5. However, even in this position it is desirable to have some space between the yoke 45 and the wall 26 with the lower end of the spacer 70 in place therebetween. This not only keeps the take-up in a tight tensioned condition, but keeps the spacer properly aligned as shown in the drawings.

When it becomes necessary to adjust the chain tension, the grease cylinder is actuated as described earlier. As the take-up unit 40 moves away from the wall 26, the spacer 70 automatically and smoothly slides down into the developing space between the yoke 45 and the wall 26. The straight vertical side of the spacer 70 slides against the vertical surface of wall 26 and parallel to the rod 72 and keeps the locking device 68 from binding on the rod. The tapered side of the spacer is in sliding contact with a correspondingly tapered slot 74 machined in the back end of the yoke 45. The slot 74 allows the spacer to slide smoothly against the yoke. The inner shoulder of the slot 74 also helps to keep the spacer aligned properly.

When adjustment of the take-up has been completed the spacer 70 will have automatically moved into snug tight contact between the yoke 45 and wall 26. Thereafter the tension on the chain will be constantly maintained, until the chain wears or stretches, even though the pressure on the grease cylinder decreases.

The angle X of the taper on the spacer 70 and the slot 74 is such that any vertical force vector resulting from the pressure on the spacer is insufficient to move the spacer 70 upward. Although the specific angle may vary somewhat, an angle of around 22 degrees has shown to be workable.

Although it may not always be necessary, the operator can screw the rod 72 down into the guide block until the head of the rod is snug against the bracket 71. This effects a positive restraint to insure that the spacer will not vibrate loose while the machine is operating.

Although it is conceivable that a single locking device of the type described would be sufficient, it is apparent from the drawings that it is preferable to have one on each side of the take-up unit to prevent cocking or uneven wear of parts.

The locking device just described offers distinct advantages over the prior art devices. Because of its unique yet simple design, it is self-actuating under its own weight. Furthermore, it allows infinite or continuous adjustment in contrast to the prior art devices which allowed adjustment only in increments. Still further it is capable of acting automatically to take-up any gap caused by surging or vibration of the trim chain during operation of the machine.

It is readily apparent that other embodiments of the locking device could differ in design from the specific one shown in the drawing. For example, the position on the gear case at which the locking device is mounted could vary across the wall 26, and other means for guiding the vertical travel of the spacer could be conceived.

The embodiments of the invention in which an exclusive property or privilege is claimed are defined as follows:

1. A take-up device for use with the trim chain on a mining machine in which a rotary auger is supported by a perpendicular support arm extending from the machine frame and the trim chain extends around the auger and support arm and is driven by the auger to cut clearance for the support arm, said take-up comprising:

a yoke slideably mounted behind the support arm in guide means affixed to the framework of the machine;

an idler roller mounted in the yoke and adapted to bear against the interior of the trim chain to effect tensioning thereof when the yoke moves away from the support arm;

actuable means for pushing the yoke and roller away from the support arm; and locking means mounted to the machine frame and including a wedge shaped spacer mounted such that it continually moves into the space between the yoke and support arm developed as the yoke is moved by the push means to block the yoke and roller from receding when the push means is deactuated.

2. The take-up device as described in claim 1, wherein the spacer is connected to the machine frame by a vertical rod which passes freely through a hole in a bracket extending horizontally from the spacer and guides the vertical movement of the spacer.

3. The take-up device as described in claim 1, wherein the spacer is self-actuating due to its own weight to automatically slide into the space between the yoke and support arm as the yoke moves.

4. The take-up device as described in claim 1, wherein the wedge shaped spacer is continuously tapered along one edge such that it will move snugly into any space created by any amount of adjustment to the take-up within the overall design limits of the unit.

5. The take-up device as described in claim 2, wherein the rod is mounted to extend upward from the guide means.

6. The take-up device as described in claim 2, wherein the spacer has a vertical edge which slides against a vertical surface on the back of the support arm.

7. The take-up device as recited in claim 6, wherein the spacer further includes an inclined edge opposite the vertical edge and which slides against a correspondingly inclined slot on the trailing edge of the yoke.

8. The take-up device as recited in claim 2, wherein the rod is threadably mounted in the machine frame such that it can be screwed further into the frame against the top of the locking means to hold it down after the spacer has moved farther down into the space between the yoke and support arm.

9. In a take-up device for a mining machine trim chain, wherein the take-up is mounted such that it moves away from a part of the machine frame when taking up slack in the trim chain, and wherein the machine includes fluid actuated means to effect such movement of the take-up, the improvement comprising:

a wedge shaped spacer mounted on the machine such that when the take-up moves to tension the chain the spacer slides under its own weight into the space between the take-up and the machine frame to block the take-up from retreating.

10. A take-up device as recited in claim 9, wherein the spacer is mounted freely on a rod attached to the machine such that it moves along and is guided by the rod when the take-up moves away from the machine frame.

11. A take-up device as recited in claim 9, wherein one edge of the spacer is vertical and slides along a correspondingly vertical edge on either the machine frame or the take-up.

12. A take-up device as recited in claim 11, wherein the opposite edge of the spacer is inclined and slides along a matching inclined surface on the other of the machine frame or the take-up.

13. A take-up device as recited in claim 10, wherein the rod is threadably attached to the machine frame and can be screwed into the frame to retain the wedge-shaped spacer in the space between the frame and the take-up.

* * * * *